United States Patent [19]

Kaneko et al.

[11] Patent Number: 4,493,882

[45] Date of Patent: Jan. 15, 1985

[54] IMAGE FORMATION METHOD AND APPARATUS

[75] Inventors: Shuzo Kaneko, Tokyo; Yasuyuki Tamura, Kawasaki; Tohru Takahashi, Tokyo, all of Japan

[73] Assignee: Canon Kabushiki Kaisha, Tokyo, Japan

[21] Appl. No.: 444,972

[22] Filed: Nov. 29, 1982

[51] Int. Cl.[3] ..... G03G 21/00

[52] U.S. Cl. ..... 430/97; 430/122

[58] Field of Search ..... 430/106.6, 125, 903, 430/97

[56] References Cited

U.S. PATENT DOCUMENTS

| | | | |
|---|---|---|---|
| 3,146,100 | 8/1964 | Kaufman | 430/125 X |
| 3,563,734 | 8/1967 | Shely . | |
| 3,592,675 | 7/1971 | Cheng | 430/125 X |
| 3,754,962 | 8/1973 | Berrier et al. | 430/125 X |
| 3,816,840 | 6/1974 | Kotz | 346/74 |
| 3,909,258 | 9/1975 | Kotz | 430/122 |
| 4,240,723 | 12/1980 | Forgo | 430/125 X |

*Primary Examiner*—Roland E. Martin

*Attorney, Agent, or Firm*—Fitzpatrick, Cella, Harper & Scinto

[57] ABSTRACT

An image formation method and apparatus utilizing the technique of removing a conductive one-component developer which adheres to the non-image bearing portion of an image bearing member such as a photosensitive member and provides the background fog of the image on the image bearing member. More particularly, it discloses an image formation method and apparatus in which one-component developer conductive particles are brought into contact with the developer forming the fog to thereby induce in said particles a charge of the opposite polarity to the polarity of the charge of the developer and the particles and the developer are attracted to each other by the coulomb force thereof, whereafter with the conveyance force of said particles, said developer is removed to thereby form a fogless image.

14 Claims, 8 Drawing Figures

IMAGE FORMATION METHOD AND APPARATUS

BACKGROUND OF THE INVENTION

1. Field of the Invention

This invention relates to an image formation method and apparatus for forming an image by conductive developer on an image bearing member such as a photosensitive member.

2. Description of the Prior Art

As an electrophotograhic method for forming a toner image on a photosensitive member, a method is widely known in which the photosensitive member is uniformly charged, an original image light or an image light by a signal-modulated light beam is applied to the photosensitive member to thereby create an image pattern-like difference in charge density on the photosensitive member and form an electrostatic latent image thereon and this latent image is developed by an insulative or conductive dry developer. Where the insulative developer is used, other particles are mixed therewith and triboelectrification is effected on a developing sleeve or triboelectrification is effected by bringing the developer into contact with the developing sleeve and the developer is caused to adhere to the surface of the photosensitive member by a coulomb force acting between the charged developer and the latent image charge on the photosensitive member to thereby form a visualized image.

Where the conductive developer is used, a charge of the opposite polarity to the polarity of the latent image charge on the photosensitive member is induced in the developer existing on the grounded developing sleeve by the charge existing on the photosensitive member and the developer is caused to adhere to the surface of the photosensitive member by a coulomb force acting therebetween to thereby form a visualized image.

Where either of the insulative and conductive developers is used, so-called fog may sometimes be created in the background of the image, and this often occurs when the charge to be removed during image exposure remains on the photosensitive member. To eliminate such fog phenomenon, a positive or negative bias is in some cases applied to the developing sleeve to prevent any potential difference from being created between the white ground portion of the photosensitive member and the developer adhering to the developing sleeve during development. This image formation method will hereinafter be referred to as the first method.

There is also an image formation method in which an image light is pre-applied to a photosensitive member to form a conductive pattern thereon and a DC bias is applied between a developing sleeve and a conductive substrate provided on the photosensitive member, whereby a uniform potential difference is formed between conductive developer and the surface of the photosensitive member and a visualized image by the developer corresponding to said conductive pattern is formed (Japanese Patent Publication No. 43821/1973; corresponding U.S. Pat. No. 3,563,734 and DE OS No. 1797187). This image formation method will hereinafter be referred to as the second method.

Alternatively, as shown in FIG. 1 of the accompanying drawings, a photosensitive layer 1 is provided on a transparent conductive substrate comprising a transparent conductive layer 2 and a transparent back-up member 3 backing up the conductive layer to make a photosensitive member, and a DC bias is applied between a developing sleeve 5 to which a conductive magnetic developer 6 is caused to uniformly adhere by a magnetic field and the substrate of the photosensitive member by a power source 4 to thereby form a uniform potential difference between the developer and the surface of the photosensitive member, and image exposure P is effected from the transparent conductive substrate side of the photosensitive member at a position whereat the conductive developer on the developing sleeve is directed to the surface of the photosensitive member, whereby a visualized image by the developer corresponding to the image pattern can be formed on the surface of the photosensitive member. This image formation method will hereinafter be referred to as the third method. In some cases, in the image bearing member of FIG. 1, an insulating layer for holding charges is provided on one side or both sides of the photoconductive layer 1.

The first method described hereinabove makes the apparatus therefor complicated and expensive but yet inferior in reliability because it necessitates the equipment of control means, a high voltage generator for corona discharge, etc. which are involved in the process of charging→exposure→development.

The second and third methods do not require the charging means which is required in the first method and thus, the apparatus therefor can be very simple as compared with the apparatus for the first method. However, where a toner image is to be formed by the third method or a method similar thereto, it is unavoidable in order to obtain a sufficient image density that fog is created. That is, in the third method, the process of causing conductive developer to adhere to the surface of an N type photosensitive member, as shown in FIG. 2 of the accompanying drawings, comprises the step of applying such a DC bias between developing sleeves 5 each having a magnet therein and the transparent conductive layer 2 from a power source 4 that the sleeve side becomes positive. In this condition, conductive magnetic developer 6 is directed to the surface of the photosensitive member by a magnetic force and a uniform potential difference is formed between this developer and the surface of the photosensitive member while, at the same time, image light is applied to the transparent conductive substrate side. In accordance with photocarriers 8 created thereby in the photosensitive member 1 correspondingly to the light image pattern and having moved to the developer side, positive charges 7 are induced in the conductive developer 6 held on the sleeves. The developer 6 is caused to adhere to the surface of the photosensitive member by a coulomb force, as shown in FIG. 3 of the accompanying drawings. In this case, even in the dark portion to which the light is not applied, charge 9 on the developer 6 side and charges 10 on the transparent conductive layer 2 side are already induced by the capacitance of the area including the dark portion photosensitive layer between the conductive developer and the transparent conductive substrate and a coulomb force is acting therebetween, and by this force, the developer is caused to adhere to the photosensitive member even in the dark portion thereof and thus, fog in created.

In the foregoing, an N type photosensitive member has been taken as an example, but even if other photosensitive member is used, a similar result will be obtained by the DC bias applied between the sleeves and the conductive layer 2 of the transparent substrate. To solve the above-noted problem, it would occur to mind to reduce the DC bias applied between the sleeves and the substrate. By this, the absolute toner density of the fogged portion can be made sufficiently low, but sufficient photocarriers cannot be produced in the portion of the photosensitive member which corresponds to the light portion of the light image pattern and as a result, the amount of developer to adhere to the light portion of the light image pattern is deficient and thus, a sufficient density cannot be obtained.

The above-described second method utilizes the nature that it is difficult for conductive developer to adhere to the durable conductive surface formed on the surface of the photosensitive member by application of light thereto. However, the relatively small amount of developer having adhered to the conductive surface, like the fog described in connection with the third method, adheres to the surface of the photosensitive member due to a coulomb force equal to or less than the coulomb force acting between the developer and the conductive substrate and provides fog.

Accordingly, the main reason why the second and third methods or methods similar thereto are not widely used as a method for forming a toner image on the surface of a photosensitive member in spite of their having an advantage over the first method is chiefly the fog created by the principle as described hereinabove.

SUMMARY OF THE INVENTION

It is an object of the present invention to eliminate any background fog in the non-image bearing portion of an image formed on an image bearing member and to form a sharp image.

It is another object of the present invention to eliminate any background fog created when an image bearing member is developed into the form of an image by a conductive developer and to form a sharp image.

It is still another object of the present invention to eliminate any background fog created when an image is formed on the surface of a photosensitive member with the aid of conductive developer by the use of the above-described second or third method and to form an image of high quality.

It is yet still another object of the present invention to provide an apparatus for forming an image free of fog in the background thereof by a simple construction.

The present invention which achieves these objects is a method having the steps of visualizing an image bearing member by a conductive one-component developer, and thereafter bringing grounded conductive particles into frictional contact with the surface of the image bearing member and bringing said particles into contact with the developer existing on the non-image bearing portion of the image bearing member, and an apparatus for carrying out such method.

The image bearing member used with the present invention may be a photosensitive member including at least a conductive layer and a photoconductive layer, or one having a pattern by a conductive portion and an insulating portion performed by printing or the like. The conductive particles used to remove fog may of course be a conductive one-component developer used in the conventional electrophotographic method, a conductive magnetic one-component developer or particles such as powdered iron ferrite or the like. The fog removing mechanism is such that a potential of the opposite polarity to the polarity of the potential induced in the conductive developer on the non-image bearing portion is created in the conductive particles brought into contact with the developer on the non-image bearing portion and a coulomb force acts therebetween. When, in this condition, the conductive particles are separated from the image bearing member, the developer having so far formed the fog can be removed from the image bearing member with said particles adhering to the developer by said coulomb force. On the other hand, the developer on the image bearing portion is strong in coupling to the image bearing member and therefore is not removed by said grounded particles. As a result, only the developer forming the fog of the non-image bearing portion can be removed.

The supply of the conductive particles to the image bearing member can be accomplished by endowing said particles with magnetism and utilizing a magnetic field produced by magnetic force producing means. In the above-described fog removing mechanism, the magnetic force acting on the conductive particles also effectively functions to remove the developer forming the fog.

The invention will become more fully apparent from the following detailed description thereof taken in conjunction with the accompanying drawings.

DESCRIPTION OF THE PREFERRED EMBODIMENT

Figure 1:
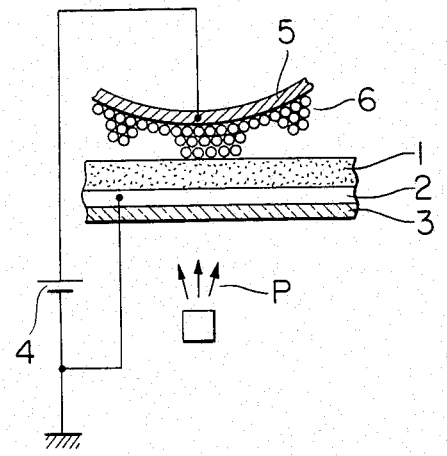
FIG. 1 is a model view of an apparatus showing an embodiment of the image formation process using a conductive magnetic developer.
Figure 2:
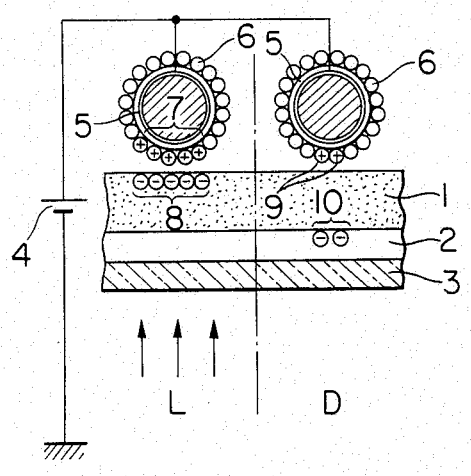
FIG. 2 illustrates the principle of the image formation by the system of FIG. 1.
Figure 3:
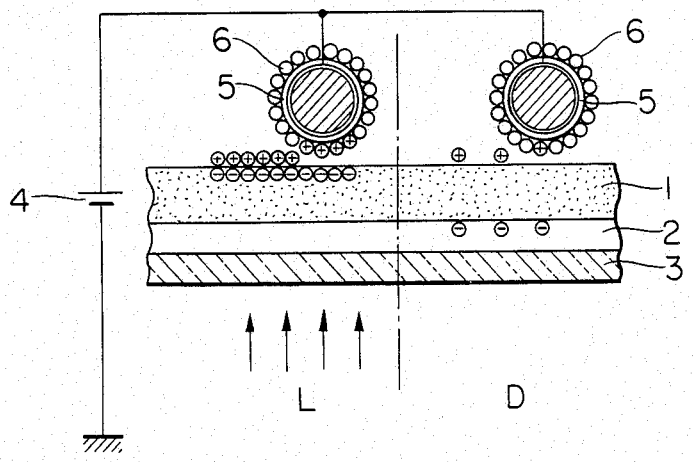
FIG. 3 illustrates a condition in which fog is created in the image formation principle of FIG. 2.
Figure 4:
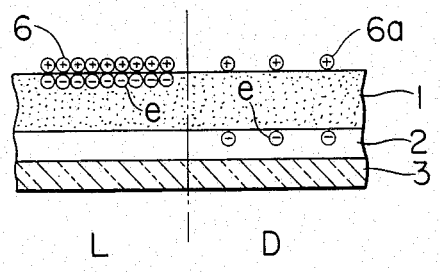
FIG. 4 is a model view showing the developer in the image bearing portion and fogged portion and the charge arrangement condition.

An embodiment of the present invention shown in the drawings will hereinafter be described. FIG. 4 shows a developer image on an N type photosensitive member developed by a developing sleeve and the state of charges in the photosensitive member. In the exposed light portion L, a developer 6 having a positive charge adheres to the surface of the photosensitive member due to a coulomb force at a distance sufficiently near negative charges e existing in the photosensitive member or on the surface of the photosensitive member. In the unexposed dark portion D, a developer 6*a* having a positive charge receives the coulomb force with negative charges e existing on a conductive substrate 2 and adheres to the surface of the photosensitive member and as a result, it provides fog of the image.

Figure 5:
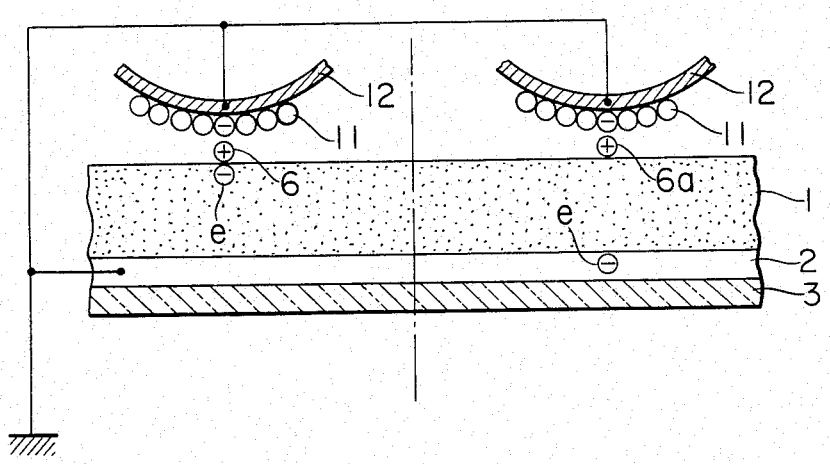
FIG. 5 illustrates the fog removing principle of the present invention.

The surface of the photosensitive member which is in such condition is redeveloped by a grounded developing sleeve 12. This state is shown in FIG. 5. In FIG. 5, reference numeral 11 designates particles which are a conductive developer having adhered to the grounded developing sleeve 12. These particles may be the same conductive magnetic developer 6 as that adhering to the previously mentioned developing sleeve 5 or may be other conductive particles and usually, the conductive magnetic developer used in electrophotography or powdered iron ferrite having a particle diameter similar to or somewhat greater than that of the developer is best suitable as such particles.

In the conductive developer 1 adhering to the developing sleeve 12, negative charges are induced by said conductive developer 11 coming close to the developer adhering to the surface of the photosensitive member and having a positive charge. As a result, a coulomb force acts between the developer 6 on the surface of the photosensitive member having a positive charge and the developer 11 adhering to the developing sleeve 12. In FIG. 4, where, as on the light portion side of the photosensitive member, the developer 6 having a positive charge adheres to the surface of the photosensitive member due to a strong coulomb force at a distance sufficiently near the negative charges e existing in the photosensitive member or on the surface of the photosensitive member, even if the developer 11 adhering to the developing sleeve 12 in which negative charges are induced comes close to the developer 6, the developer 6 having a positive charge remains held on the surface of the photosensitive member by the strong coulomb force. Of course, the developer on the surface of the photosensitive member having a positive charge may receive other dynamic influences than electrostatic force, for example, in this case, magnetic force and impact during contact, due to the developing sleeve and the developer adhering to the developing device, and more or less of said developer is removed from the surface of the photosensitive member. In reality, however, said developer remains held on the surface of the photosensitive member because the coulomb force with the aforementioned negative charges existing in the photosensitive member or on the surface of the photosensitive member.

However, in FIG. 4, the developer 6*a* adhering to the surface of the photosensitive member due to the relatively weak coulomb force with the negative charges e existing on the conductive substrate is simply moved from the surface of the photosensitive member to the developer 6*a* side on the developing sleeve 12 by the combined effect of the coulomb force with the negative charges induced in the developer 11 on the developing sleeve 12, the magnetic force and some other force such as friction force. As a result, there has been obtained a sharp image pattern-like toner image free of fog.

Although the grounded developing sleeve 12 has been mentioned as an example hereinabove, an effective result has also been obtained by applying to the developing sleeve 12 a sufficiently small DC bias below 50% as compared with the DC bias applied to the developing sleeve 5, or an AC bias of the same degree or below said DC bias.

While description has so far been made with the third method as an example, the present invention can likewise be applied to the second method by taking the dynamic force into account. As the method of grounding the developer 11, the sleeve 12 may be grounded or other grounded electrode may be brought into contact with the developer itself.

Description will hereinafter be made of some specific examples of the construction of an apparatus using the image formation method of the present invention.

(EXAMPLE 1)

Figure 6:
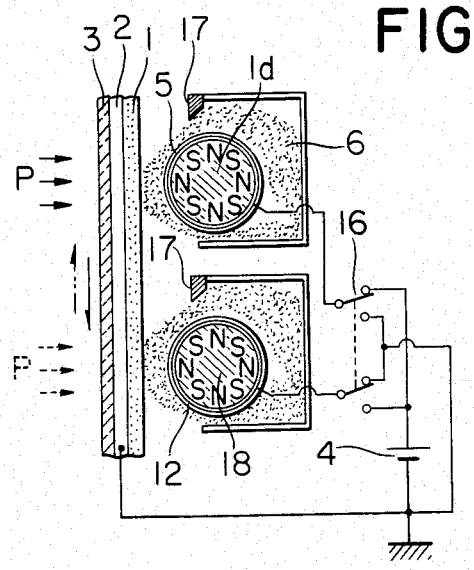
FIGS. 6 to 8 are cross-sectional views of the essential portions of an image formation apparatus adopting the fog removing mechanism of the present invention.

As shown in FIG. 6, the first developing sleeve 5 and the second developing sleeve 12 constitute discrete developing devices. The respective developing devices, including the developing sleeves, may be of different configurations. Of course, however, either of the developing sleeves is one in which a magnet for conveying and holding conductive magnetic developer is suitably disposed. A DC bias of +600 V was applied to the first developing sleeve 5 by the use of a power source 4 and development was effected while the photosensitive member was being exposed to image light, whereafter fog was removed by the grounded second developing sleeve 12. In this case, the direction of relative movement of the photosensitive member and the two developing devices can be selected by changing the application of the biases to the first developing sleeve 5 to which the DC bias was applied and the grounded second developing sleeve 12, by means of a switch 16 or the like.

That is, when the bias is being applied to the sleeve 5, the photosensitive member 1 is moved in the direction of solid-line arrow, and when the bias is being applied to the sleeve 12, the photosensitive member 1 is moved in the opposite direction, i.e., the direction of dot-and-dash-line arrow.

Designated by 17 is a scraper plate for maintaining the amount of developer supplied onto the sleeve constant. The ground potential of the developer for removing fog may be used by changing this scraper plate into a grounded electrode.

(EXAMPLE 2)

Figure 7:
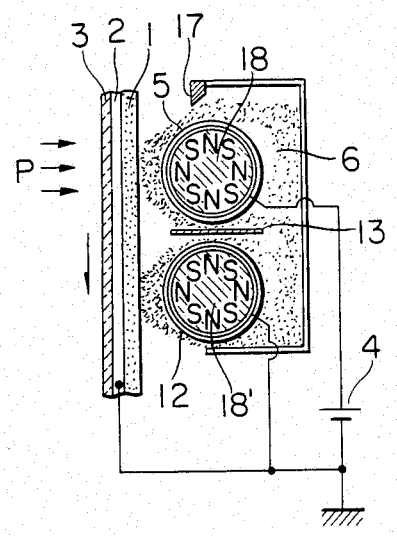

As shown in FIG. 7, the first developing sleeve 5 and the second developing sleeve 12 were made into a developing device so that the conductive magnetic developer could be commonly used for these sleeves. In this case, an insulating layer 13 was provided between the first developing sleeve 5 and the second developing sleeve 12 and a measure was taken so that any short-circuiting by the conductive developer could not occur between the developers adhering to the respective sleeves.

With the above-described construction, it has become possible that the developer collected by fog removal is reduced for development, and this means an economical advantage.

(EXAMPLE 3)

The apparatus of this example is similar to the apparatus of Example 1, and in this example, a single developing sleeve is used as the first and second developing sleeves. That is, a DC bias is first applied to the developing sleeve, the development by image exposure is effected with said developing sleeve as the first developing sleeve, and subsequently the same sleeve is used as the second developing sleeve and the surface of the photosensitive member developed by the first developing sleeve is again developed by the use of the grounded sleeve, thereby removing any fog. Again with this apparatus, the collected developer is reusable and, because the developing device comprises a single sleeve, the construction of the apparatus is simpler.

(EXAMPLE 4)

Figure 8:
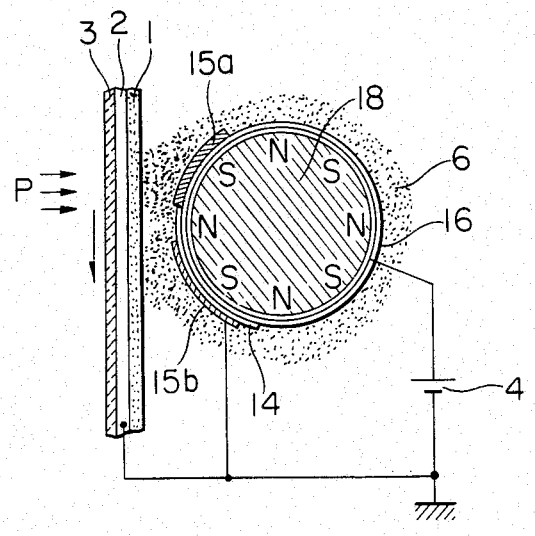

As shown in FIG. 8, conductive layers 15*a*, 15*b* and an insulating layer 14 were disposed on a conductive developing sleeve 16, whereby the same sleeve was endowed with an effect similar to the effect of having a first developing sleeve and a second developing sleeve. In this case, the developer adheres to the sleeve while assuming a brush-like form. Accordingly, the developer is of low resistance in the direction in which the brush extends, while it is of relatively high resistance in the direction along the circumference of the sleeve. As shown in FIG. 8, the insulating layer 14 on the circumference of the sleeve 16 can be made somewhat wider than the electrode 15*b*, thereby preventing short-circuiting between the insulating layer 14 and the sleeve 16.

Again in this case, the developer is reusable, and the fact that the developing device comprises a single sleeve and the direction of movement of the photosensitive member is fixed leads to the practicality of the apparatus.

In any of the examples enumerated above, the direction of rotation of the magnet in the developing sleeve can be freely selected. Further, in Examples 1-3, the developing sleeve is not rotated or may be rotated in any direction. Also, instead of the sleeve having a magnet disposed therein, use may be made of only a sleeveless conductive magnet which merely provides an electrodes. That is, use may be made of a developing device having a developer holding member having a magnet for holding conductive magnetic developer and having a construction provided with an electrode capable of supplying charges necessary for such developer. Also, the conductive magnetic developer or the conductive magnetic particles used with the present ivention may be one of relatively low resistance or even one of relatively high resistance which is used with its apparent resistance reduced by rapidly rotating the developing sleeve or, when the sleeve is not employed, the magnet roller or the internal magnet during development a is disclosed in Japanese Patent Publication No. 31136/1978 (corresponding U.S. Pat. No. 4,121,931).

As regards the direction of rotation of the magnet, the magnet is rotated so that on the surface of contact between the developer and the photosensitive member, the developer to which a DC bias is applied is conveyed in the same direction as the direction of movement of the photosensitive member, whereby a pool of developer is created on the upstream side of the direction of movement of the photosensitive member. Much of the developer in this developer pool which has a relatively weak magnetic action adheres to the surface of the photosensitive member and further, on the downstream side of the developing station, a relatively strong magnetic force acts on the developer and therefore, excess adherence of the developer to the photosensitive member was prevented and a sharp image was obtained. Also, where the magnet is rotated so that on the surface of contact between the developer and the photosensitive member, the developer is conveyed in the direction opposite to the direction of movement of the photosensitive member, a developer pool is created on the downstream side of the direction of movement of the photosensitive member, and much of the developer existing in a place of relatively weak magnetic action in this developer pool adheres to the surface of the photosensitive member, and in some cases this was suitable for enhancing the development density. Also, a regards the developer for removing the grounded fog to which no bias was applied, it proved better to rotate the magnet or the sleeve so that on the surface of contact between the developer and the photosensitive member, the developer was conveyed in the same direction as the direction of movement of the photosensitive member to prevent excess adherence of the developer to the surface of the photosensitive member.

For example, in the case as shown in Example 4 above, if the reasons set forth above are taken into consideration, it is better to select the direction of rotation of the magnet such that the developer is conveyed in the same direction as the direction of movement of the photosensitive member.

Also, even if a weak light impinges on the photosensitive member when the step of removing the fog is being carried out, it will not greatly affect the image formation. However, it is desirable to carry out the fog removing step in the dark so that an electric field is not applied to the photosensitive member by the charges of the developer of the fog and no excess introduction of charges takes place upon application of light.

A specific embodiment of the present invention will now be described. As the photosensitive member, use was made of one prepared by dispersing in toluene a mixture of CdS powder activated by Cu and acrylic resin at a weight ratio of 100:7, applying it to the conductive surface of transparent conductive film produced by Diecell Kagaku Kogyo Co., Ltd. (trade name: CELEC ®-KEC) by means of a doctor blade, and drying it at 70° C. for thirty minutes. As the conductive magnetic developer, use was made of IMAGING POWDER (TYPE 355 VQC) produced by Minnesota Mining and Manufacturing Inc. The developing device used was provided with a developing sleeve a stainless steel having a magnet disposed therein, and the internal magnet was rotated at about 1400 r.p.m. First, a DC bias was applied between the developing sleeve and the transparent conductive layer so that the developing sleeve side became positive, and an image was flash-exposed at an exposure amount of about 4 lux·sec. from the transparent film side of the photosensitive member to the position at which the developer was in contact with the photosensitive member. In the meantime, the photosensitive member is moved relative the developing device at a speed of 60 mm/sec. When the applied DC bias was 100 V, the fog in the unexposed portion was thin but the image density was low also in the exposed portion. In contrast, when the applied DC bias was 300 V, the exposed portion had a sufficient density but the fog also became thick. At this point, the DC bias of 300 V was cut off by a switch, the developing sleeve was grounded, the rotation of the magnet in the sleeve was reversed and the photosensitive member was moved reversely, and the developer on the developing sleeve was again brought into contact with the developed portion. As a result, the developer which had so far provided the fog was removed and a sharp image was obtained.

As described above, the present invention can obtain a sharp visible image by developer by a very simple method in electrophotography, and can greatly reduce the cost of the apparatus for image formation as compared with the image formation method of the prior art. Further, the present invention has the following effects:

(1) The developer on the developer holding member can be caused to adhere to the surface of the photosensitive member, whereafter fog can be removed by the same or discrete developer holding member. Therefore, in the process during which the developer is caused to adhere by said developer holding member, a high DC bias can be applied to obtain a developed image of high density without the fog being minded. Accordingly, it is not necessary to precisely control the bias in advance and thus, control is easy. Also, an inexpensive power source relatively inferior in stability can be used as the power source used to apply such DC bias.

(2) Since a high bias can be applied to the developer holding member, sufficient photocarriers can be produced in the photosensitive member for a small exposure amount and a sharp image can be obtained even for a small exposure amount.

What we claim is:

1. An image formation method comprising the steps of:

developing an image bearing member with a first one component conductive developer retained by first retaining means; and rubbing the surface of the image bearing member bearing a developed image with a second one component conductive developer retained by second retaining means and maintained at a potential to remove the developer which forms a fog in the non-image area of the image bearing member.

2. An image formation method according to claim 1, wherein said first and second retaining means are parts of a common retaining member.

3. An image formation method according to claim 1, wherein said first and second one component conductive developers are of the same composition and are retained in the same developing container.

4. An image formation method according to claim 1 or 2, wherein at least one of said one component developers is magnetic and is retained by a magnetic field generated by the associated retaining means.

5. An image formation method comprising the steps of:

developing the conductive and non-conductive patterns of an image bearing member with a first one component conductive magnetic developer retained by first retaining means; and rubbing the surface of the image bearing member bearing a developed image with a second one component conductive magnetic developer retained by second retaining means and maintained at a potential for removing the developer which forms a fog of the non-image area of the image bearing member.

6. An image formation method according to claim 5, wherein said first and second retaining means are parts of the same retaining member.

7. An image formation method according to claim 5, wherein said image bearing member has a transparent base, a photoconductive layer and an intermediate conductive layer, and wherein said developing step includes supplying said first developer to the photoconductive layer side while image information is applied from the base side, and applying a bias voltage between the conductive layer and the first developer.

8. An image formation method according to claim 5 or 7 wherein said first and second developers have the same composition and are provided in the same developer container.

9. An image formation method comprising the steps of:

developing an image bearing member with a first magnetic one-component conductive developer retained by first retaining means; and rubbing the surface of the image bearing member bearing a developed image with a second magnetic one component conductive developer retained by second retaining means and maintained at a potential for removing the developer which forms a fog in the non-image area of the image bearing member.

10. An image formation method according to claim 9, wherein said first and second retaining means are parts of the same retaining member.

11. An image formation method according to claim 9, wherein said first and second developers have the same developer composition and are provided in the same developer container.

12. An image formation method according to claim 1, wherein said second one component conductive developer is grounded.

13. An image formation method according to claim 5, wherein said second one component conductive developer is grounded.

14. An image formation method according to claim 9, wherein said second one component conductive developer is grounded.

* * * * *